United States Patent [19]

Simpson

[11] 4,078,472

[45] Mar. 14, 1978

[54] SHOTGUN SHELL RELOADING TOOL

[76] Inventor: Frank H. Simpson, Rte. #2, Box 276, Cornelius, Oreg. 97113

[21] Appl. No.: 676,137

[22] Filed: Apr. 12, 1976

[51] Int. Cl.[2] ..... F42B 33/02

[52] U.S. Cl. ..... 86/23; 86/27; 86/38

[58] Field of Search ..... 86/23–38, 86/44; 74/88, 128, 826

[56] References Cited

U.S. PATENT DOCUMENTS

| | | | |
|---|---|---|---|
| 196,545 | 10/1877 | Smoot et al. | 86/27 |
| 2,031,850 | 2/1936 | Peterson | 86/27 |
| 3,058,387 | 10/1962 | Hoyer | 86/27 |
| 3,097,560 | 7/1963 | Ponsness et al. | 86/27 |
| 3,105,408 | 10/1963 | Bachhuber | 86/29 X |
| 3,320,848 | 5/1967 | Ponsness | 86/38 |
| 3,450,000 | 6/1969 | Ponsness | 86/25 |
| 3,762,228 | 10/1973 | Crepin | 74/88 |
| 3,771,411 | 11/1973 | Hazel | 86/27 |

FOREIGN PATENT DOCUMENTS

| | | | |
|---|---|---|---|
| 1,224,060 | 6/1960 | France | 86/38 |

*Primary Examiner*—Harold Tudor
*Attorney, Agent, or Firm*—Francis Swanson

[57] ABSTRACT

A tool for reconditioning and reloading spent shotgun shells is disclosed. The tool has a movable table upon which is mounted a rotating die cage. The cage contains a series of floating dies for sizing the spent shells. A fixed tool head at the top of the apparatus carries a series of filling tubes and crimping dies. Means for rotating the die cage and the operation of the floating dies is described.

2 Claims, 6 Drawing Figures

SHOTGUN SHELL RELOADING TOOL

BACKGROUND OF THE INVENTION

1. Field of the Invention

The invention relates to tools for reloading spent shotgun shells in general and more particularly to those having rotating die carriers and floating sizing dies.

2. Description of the Prior Art

There is a distinct economic advantage to reloading spent cartridges as these may be re-used several times. Thus, numerous reloading tools for spent shotgun shells exist in the prior art.

Some have multiple dies which are fixed solidly to a table, the loading operations being performed by forcing the shell into each die successively through the various steps in the process. Some are very elaborate and are motor driven while others are simple hand operated devices.

SUMMARY OF THE INVENTION

It is a principal object of the invention to provide a loading tool having a plurality of floating dies which contain the spent shell and slide up and down during the operation of the machine.

It is a further object of the invention to provide a tool wherein the die cage, primer carrier and feed mechanism all move up and down on a central post during the various loading steps.

A further object of the invention is to provide an indexing and detente mechanism which is actuated by the travel of the die cage so that precision positioning of the shells with the dies is provided as they proceed through the loading sequences.

Further objects and advantages of the invention will become apparent to those skilled in the art or referral to the accompanying drawings and specifications.

DETAILED DESCRIPTION

Figure 3:
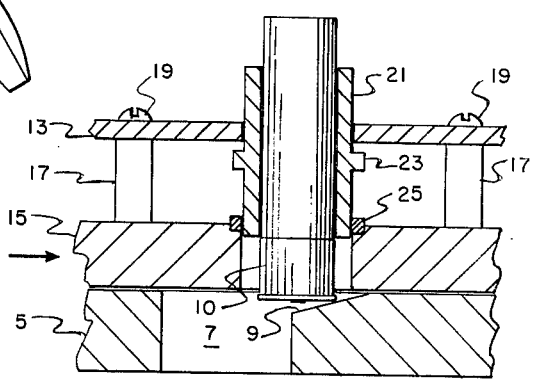
FIG. 3 is a sectional view of the die cage taken along line 3 — 3 of FIG. 2.

Referring now to the drawings, the reloading tool consists of a base 1 upon which is mounted a vertical shaft 3. Operatively connected to base 1 is a movable table 5. Table 5 slides up and down on shaft 3 but does not rotate. The table 5 contains various holes and slots to facilitate the carrying out of various operations in the loading sequence to be described below. Slot 7 and inclined land 9, as shown in FIG. 3 facilitate initial insertion of a shell to be reloaded and the start of the loading procedure.

A rotatable die cage 11 is mounted on the table 5 and slides up and down with the table on shaft 3. The die cage consists of an upper die block 13 and a lower die block 15. These are joined by spacers 17 and bolts 19.

Interposed between upper and lower die blocks 13 and 15 and intruding into appropriate holes in each of them is a series of slidable dies 21. Each die is tubular shaped, hollow, and has an annular shoulder 23 thereon.

An annular ring 25 is mounted in the upper surface of the lower die block 15 at each hole through which a die 21 passes. This ring 25 protrudes slightly upward above the upper surface of lower die block 15 and serves an important purpose to be described below.

Figure 2:
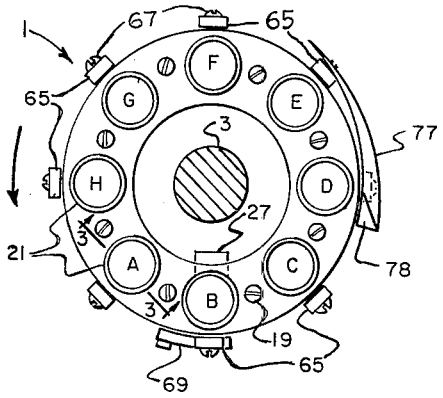
FIG. 2 is a plan view of the die cage taken along line 2 — 2 of FIG. 1 drawn to illustrate the various positions during the loading sequence and to further illustrate the relation of the shell hold down latching mechanism and the indexing finger mechanism.
Figure 6:
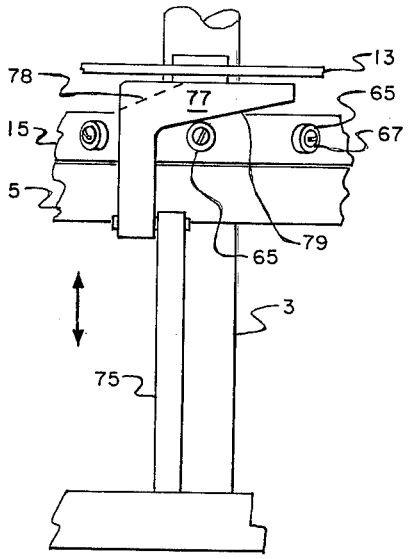
FIG. 6 is a side elevational view of the finger mechanism which is part of the die cage indexing apparatus.
Figure 4:
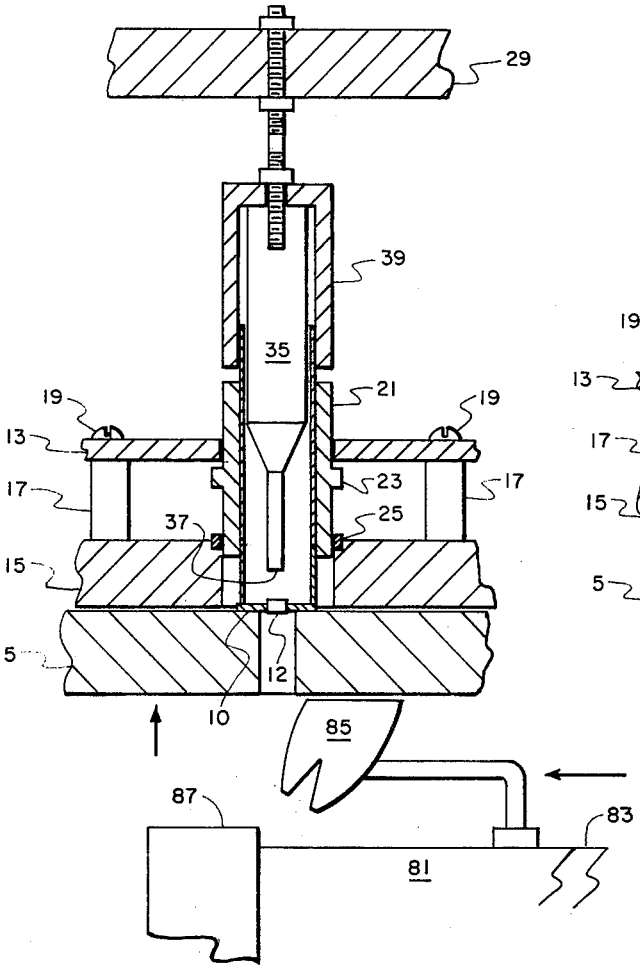
FIG. 4 illustrates the relation of the primer punch and die as the depriming and resizing operation begins.

A shell hold-down latching mechanism 27 as shown in FIG. 2 is mounted on the table 5 and may take the form of any suitable mechanism which serves to hold the base of the shell to be reloaded against the upper surface of the lower die block 15, as shwon in FIG. 4 during at least a portion of the reloading operation. Latches are old and well known in the prior art. An example of a shell latching mechanism is shown in the French Patent No. 1,224,060 to Cosson at FIG. 6.

Fixed to the upper end of shaft 3 is a fixed tool head 29 upon which is mounted a powder container 31 and a shot container 33. A series of tools are also mounted on the head 29. There is a primer punch 35 having a long shaft 37 and a cylindrical outer jacket 39. Powder filling tube 41 and shot filling tube 43 are mounted on the tool head 29. A wad holder 45 and a series of crimping tools 47 and 49 are also fixed to head 29 as is a shell ejector tool 51 which may consist of an elongate tube or bar.

The vertically movable table 5 is connected to an actuating mechanism consisting of a shaft 53 mounted on base 1 by a plurality of bearing blocks 55. An elongated handle 57 having knob 59 on its end is attached to shaft 53. A crank 61 and link 63 couple the shaft 53 to the table 5.

Rotating die cage 11 has a plurality of cylindrical bearings 65 mounted on the outer surface of lower block 15 and are attached by shafts 67. These bearings 65 form a part of the indexing mechanism described below.

On table 5 is mounted a detente 69 having a semi-circular groove 71 at its upper edge. Groove 71 is sized to mate with bearings 65. Detente 69 is biased to the upper position by a spring 73. Detente 69 also forms a part of the indexing mechanism.

Along with bearings 65 the indexing mechanism consists of a mounting block 75, pivotally mounted spring loaded finger 77 having an angular surface 78 and a lower surface which defines an incline plane 79. This assembly is mounted on base 1. A chute may be attached to base 1 to carry shells which are completely loaded away from the machine.

A fresh primer feed mechanism 81 and a sliding primer insert block 83 are mounted on the vertically moving table (5) such feed mechanisms having sliding insert blocks are well known in the art. Their method of operation is illustrated in U.S. Pat. No. 3,320,848. Attached to the sliding insert block 83 is a chute 85 which directs spent primers into a cup 87 after they are ejected from the spent shell.

The primer feed mechanism 81, insert block 83, chute 85, and cup 87 all travel up and down with table 5 during the various loading sequences. A cam 89 is mounted on base 1. A cam follower 91 attached to insert block 83 travels along surface 93 of cam 89 under the influence of spring 95 as the table 5 travels up and down.

OPERATION

Figure 1:
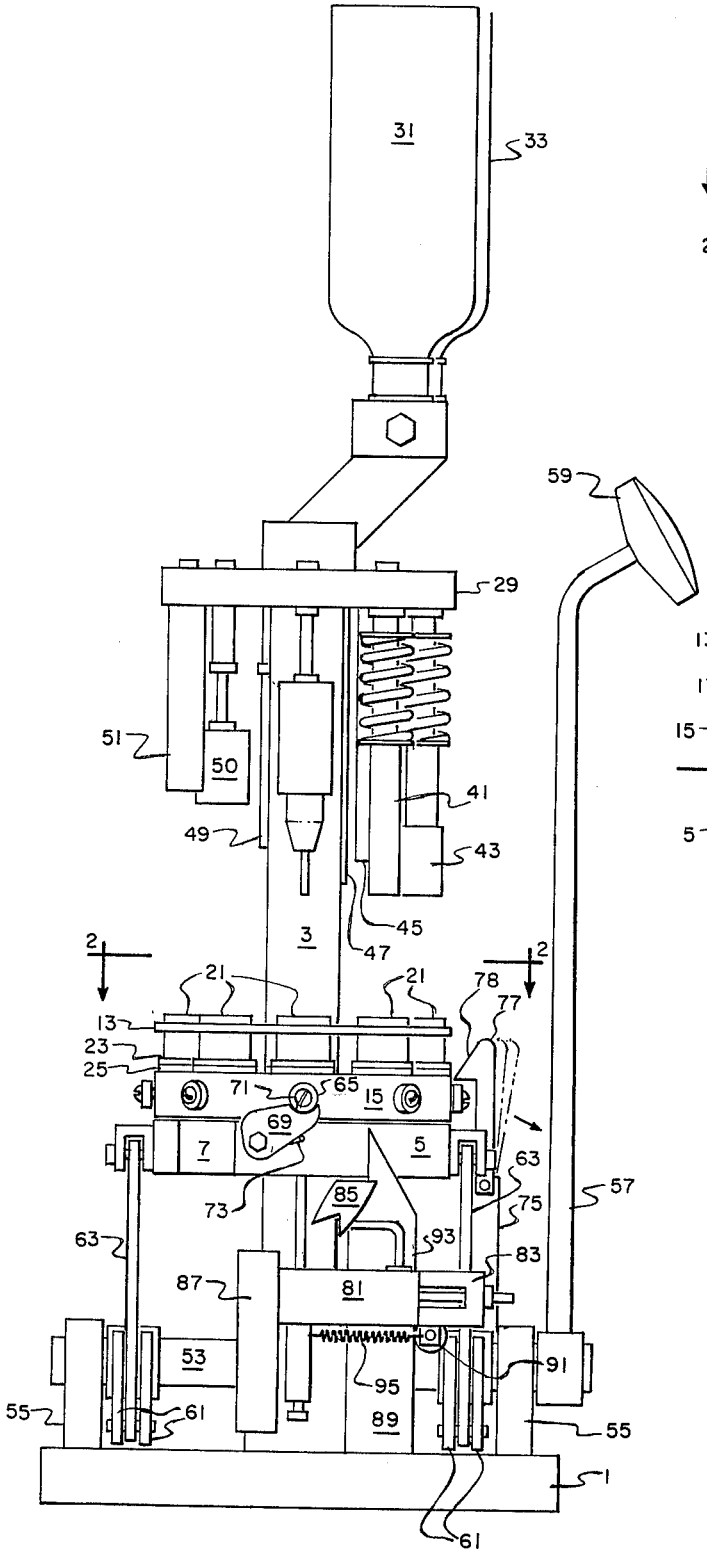
FIG. 1 is a front elevational view of the reloading tool.

FIG. 2 is a plan view of the rotating die cage 11 taken along line 2 — 2 of FIG. 1 and illustrates the positions through which a shell is indexed during the loading operations.

Loading is started by manually inserting the spent shot shell 10 through slot 7 in table 5 and into floating die 21 at position A. Handle 57 is then turned a little, causing die cage 11 to rotate slightly. The lower lip of the inserted shell/now contacts inclined land 9 on non-rotating table 5 and because the shell is bulged from firing and thus slightly larger at its base than die 21, forces the floating die 21 to move toward the uppermost position as shwon in FIG. 3. Further movement of handle 57 causes the die cage 11 to rotate toward position B where shell hold-down latch 27 will engage the base of the shell 10.

Die cage 11 is caused to rotate and thus index into the proper positions because the upward movement of table 5 brings a bearing 65 into contact with the lower surface 79 of spring loaded finger 77. Surface 79 of finger 77 defines an inclined plane. Thus further upward motion of table 5 will cause bearings 65 to move along surface 79 and rotate the cage 11. Bearings 65 are positioned on lower block 15 so that as they travel past the end of finger 77 the table 5 can continue upward to its full stroke above finger 77.

As the table 5 moves back downward a bearing 65 will contact angular surface 78 on finger 77. Since finger 77 is spring loaded and pivotally attached to mounting block 75 it will move outward and allow descending table 5 and die cage 11 to pass by. Spring force will then urge the finger 77 back into its original position so that when table 5 again moves upward a bearing 65 will once more contact inclined lower surface 79 on finger 77 and induce the indexing motion.

Figure 5:
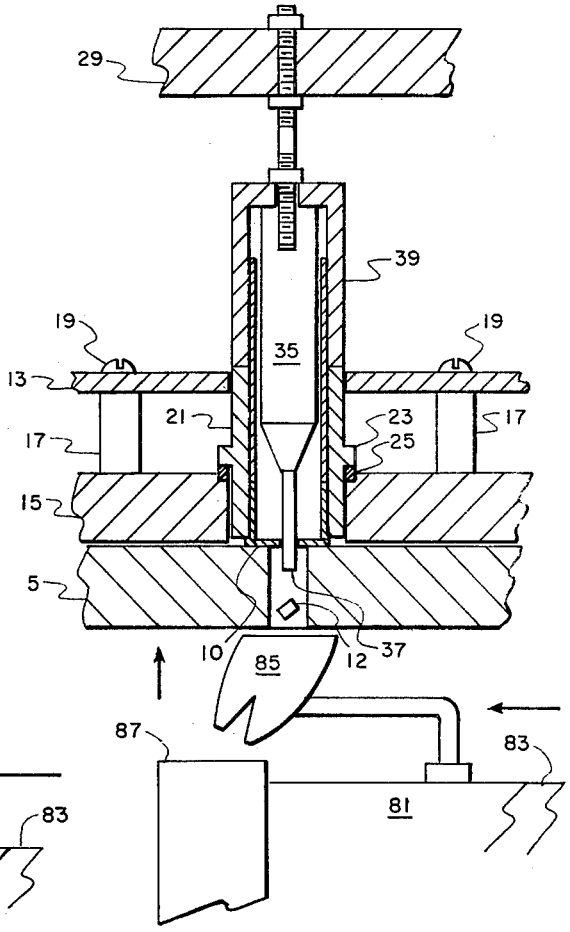
FIG. 5 illustrates the relation of the primer punch and floating die and the die cage at the completion of the depriming, resizing operation.

As the shell 10 within floating die 21 reaches position B one of the bearings 65 engages the detente 69 at groove 71. The cage 11 is now firmly aligned with the various members mounted on fixed head 29 and in position to perform operations in sequence. As the handle 57 is now brought further through its stroke, the table 5 raises upward on vertical shaft 3. Punch shaft 37 passes in through the open upper end of the shell 10 and contacts the spent primer 12 forcing it out of the shell 10 and through a hole in lower die block 95 where it falls into chute 85 and is directed into cup 87. The cylindrical jacket 39 now contacts the upper end of floating die 21 and as the upward movement of rotating cage 11 and table 5 is completed, floating die 21 is forced downward over the shell 10 until the annulai shoulder 23 on die 21 contacts annular ring 25 mounted in the upper surface of rotating lower die block 15. This depriming and resizing sequence is illustrated by FIGS. 4 and 5. The important purpose of ring 25 will now become apparent. In any loading operating of this kind stray lead shot will inevitably find its way into the mechanism. Since dies 21 float up and down it is vital to provide a means to prevent such stray shot from getting in between the lower surface of annular shoulder 23 on dies 21 and the upper surface of lower die block 15 during the deprime-resize stroke. Since annular ring 25 is equal to or slightly larger in diameter than shoulder 23 on die 21 and is raised above the upper surface of block 15, stray shot are effectively prevented from interfering with the downward motion of die 21.

After the operation just described resizing and depriming of the shell 10 is complete and the die 21 surrounds the shell 10 to its base. Shell 10 hold-down latch 27 having engaged the die 21 and shell, it holds them down firmly so that as table 5 moves downward, the shell will be reprimed.

As table 5 moves upward, carrying with it the primer feed mechanism 81 and associated components, cam follower 91 travels along the cam surface 93. As the follower 91 reaches the top of cam 89 spring 95 pulls the primer insert block 83 inward bringing the chute 85 into position to catch the spent primer 12 and guide it into cup 87. The spring action then positions the fresh primer and primer insert block 83 so that the fresh primer is inserted into the spent shell. Primer feed mechanisms are often coupled to a primer tray and feed chute to provide a continuing supply of fresh primers automatically. One such is shown in the previously referenced U.S. Pat. No. 3,320,848. Because they are well known in the art one is not shown here. However, it will be recognized by those skilled in the art that one could be readily attached to this invention.

It will be noted that as the table 5 travels upward and downward through each cycle, several operations are performed either simultaneously or in close sequence. For example, on each downward stroke of the table 5 the shell in position C receives powder through tube 41 from container 31. The shell at position D receives shot through tube 43 from container 33. However, before the table 5 travels up on a given stroke, a wad must be manually inserted in the wad-holder 45. A shell at position E gets an initial crimp from tool 47 mounted on head 29. The shell of position E gets its final crimp from tool 49, also attached to head 29, while the shell at position G gets a final rounding of its upper surface from tool 50. This rounding operation greatly facilitates insertion of the shell into the shotgun chamber. At position H the completely reloaded shell is ejected from die 21 by ejection tool 51. Obviously any convenient chute or receptical could be provided to receive the reloaded shell. Thus, none has been shown.

It will be noted that ejection and resizing take place simultaneously on the upward movement of table 5 and maximum force is exerted by the handle mechanism just as the handle 57 goes over-center above shaft 53 on base 1. This configuration greatly facilitates the sizing of badly bulged shells and requires less effort to eject a loaded shell from die 21.

Having disclosed the preferred embodiment of my invention and described it in detail, it will be apparent to those skilled in the art that many modifications could be made without departing from the true scope and spirit of my invention. I claim as my invention all such modifications as fall within the scope of the appended claims.

I claim:

1. Apparatus for depriming and resizing a spent ammunition shell comprising:

a base;

a vertical shaft on the base;

a table movable up and down on the shaft;

means for moving the table up and down on the shaft;

a rotatable die cage on the table, the die cage including an upper and a lower die block joined in spaced apart relation so as to define a die containing space;

a hollow floating shell resizing die having an annular ring thereon carried by the die cage in the space between the die blocks, the die always at least partially contained within each die block, the die movable from a first position to a second position within the die block by contact of the die with a fixed tool and from the second position to the first position by manual insertion of a shell into the die;

a tool head mounted on the upper end of the shaft and having thereon a downwardly depending deprimming punch, the punch surrounded at its upper end by a hollow cylindrical jacket which defines a space for receiving the open end of the shell between the inner surface of the jacket and the punch, the lower end of the hollow jacket adapted to contact one end of the floating die after the punch has deprimed the shell and force the die from the first position to the second position when the cage is moved upward along the shaft;

an indexing means for rotating the cage, said means comprising a plurality of bearings on the outer edge of the cage, a detente on the table adapted to engage a bearing and prevent rotation of the cage, and a pivotable finger connected to the base and having an inclined plane thereon adapted to mate with a bearing on the cage during upward movement of the cage along the shaft so that the bearing is urged along the inclined plane and rotates the cage until the detente engages a bearing on said cage.

2. Apparatus according to claim 1 wherein the lower die block contains an annular ring in surrounding relation to the floating die, the ring protruding above the upper surface of the die block so that the ring prevents shot from intruding into the space between an annular shoulder on the floating die and upper surface of the lower die block to interfere with downward movement of the die.

* * * * *